United States Patent [19]

Muncy

[11] Patent Number: 4,594,803

[45] Date of Patent: Jun. 17, 1986

[54] SPENT SHELL RECEIVER

[76] Inventor: Floyd B. Muncy, 4229 Voncille, Ft. Worth, Tex. 76117

[21] Appl. No.: 695,377

[22] Filed: Jan. 28, 1985

[51] Int. Cl.[4] ..... F41C 27/00

[52] U.S. Cl. ..... 42/1 T

[58] Field of Search ..... 42/1 T, 1 R; 89/33.4

[56] References Cited

U.S. PATENT DOCUMENTS

| | | | |
|---|---|---|---|
| 1,201,189 | 10/1916 | Johnson | 42/1 T |
| 2,866,289 | 12/1958 | Wilcox | 42/1 T |
| 3,153,981 | 10/1964 | Brass | 42/1 T |
| 3,618,458 | 11/1971 | Pruonto et al. | 42/1 T |
| 4,020,738 | 5/1977 | Martinez | 42/1 T |

*Primary Examiner*—Deborah L. Kyle
*Assistant Examiner*—Michael Carone
*Attorney, Agent, or Firm*—James E. Bradley

[57] ABSTRACT

A spent shell receiver for a shotgun releasably mounts to the shotgun adjacent the ejection slot. The spent shell receiver includes a bracket which has a rearward portion that clamps to the trigger guard. The forward portion of the bracket has a lip that fits over the upper edge of the forestock. The container for receiving the spent shell has a window that aligns with the ejection slot. The container is mounted to the bracket by means of a hinge which is perpendicular to the axis of the barrel. This allows outward pivoting movement to expose the ejection slot for cocking.

5 Claims, 4 Drawing Figures

SPENT SHELL RECEIVER

BACKGROUND OF THE INVENTION

1. Field of the Invention

This invention relates in general to guns, and in particular to a receiver for use with shotguns to catch shells as they are ejected from the shotgun.

2. Description of the Prior Art

Automatic and pump shotguns have ejection slots through which the shell ejects as the shot is fired. Often, the hunter does not intend to leave the spent shell on the ground, thus must stop to pick the shell up. If the hunter is hunting in an area where cattle are present, there is a danger that cattle will eat the shells if left remaining on the ground. Also, many hunters intend to reload the spent shells.

Stopping to pick up the shells is a problem because if the hunter has shot a bird, he may lose sight of the bird as he stops to look for his shells. Also, if the hunter is engaged in trap shooting on a range, due to the time requirements of trap shooting, he will not have time to pick up his spent shells.

Although there are many reasons to have a spent shell receiver, the inventor is not aware of any being marketed. There are some patents that show receivers for spent shells. These include U.S. Pat. Nos. 1,201,189, Johnson, Oct. 10, 1916; 3,153,981, Brass, Oct. 27, 1964; 4,020,738, Martinez, May 3, 1977; and 3,618,458, Pruonto, et al., Nov. 9, 1971. For a receiver to be feasible, it must be quickly mountable and detachable from the firearm. Also, the receiver must provide provisions for quick access to the ejection slot so that the hunter can operate the cocking lever after reloading.

SUMMARY OF THE INVENTION

The spent shell receiver of this invention has a forward and rearward mounting means for quickly mounting the receiver to a shotgun. The rearward mounting means includes a rear support that fits around the forward portion of the trigger guard. A retaining block mates from the other side and a wing nut secures the retaining block to the rear support, firmly locking the mounting bracket to the trigger guard. On the forward end of the mounting bracket, a flange or lip extends inwardly to fit on the upper edge of the forestock.

The shell container is mounted to the mounting bracket by a hinge that allows the shell container to pivot outwardly about a vertical axis with respect to the horizontal axis of the barrel. This provides quick access to the ejection slot. The shell container has a window located adjacent the ejection slot for catching shells as they are ejected. The trap door at the bottom allows the shells to be quickly removed.

DESCRIPTION OF THE PREFERRED EMBODIMENT

Figure 1:
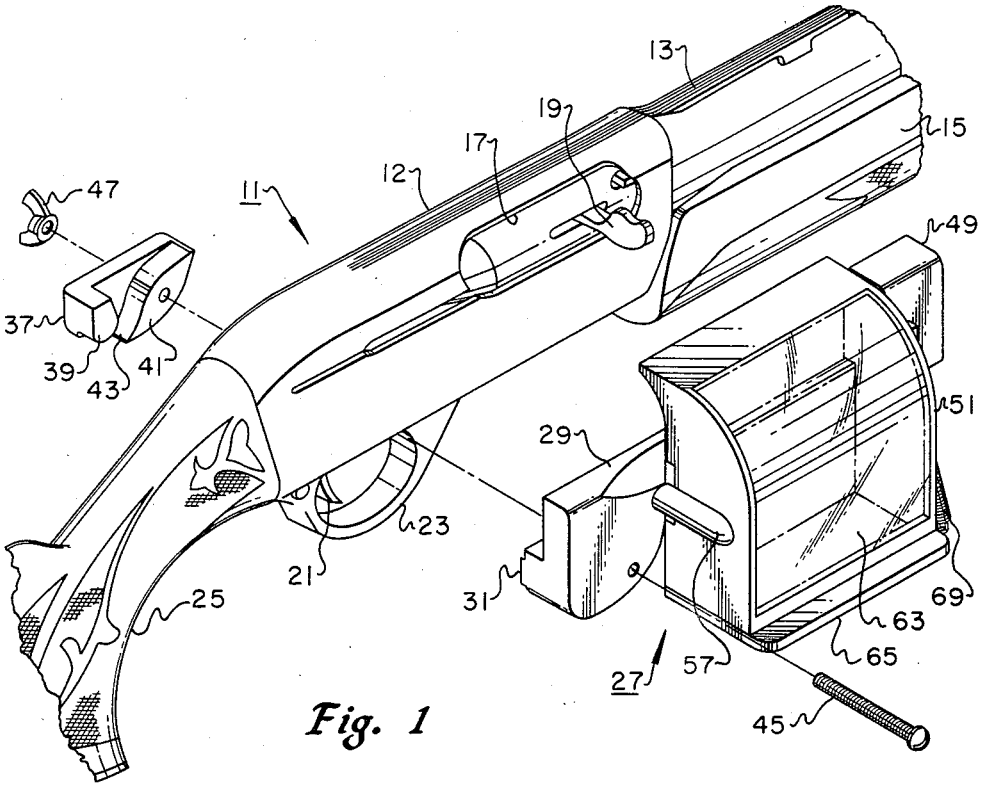
FIG. 1 is a perspective view of a shell receiver constructed in accordance with this invention, and also partially showing a shotgun.

Referring to FIG. 1, shotgun 11 is of the type known as an "automatic". It has a receiver section 12 located at the end of a barrel 13. A forestock 15 extends under the barrel 13 forwardly from the receiver section 12. The receiver section 12 has an ejection slot 17 which ejects the shell once the gun is fired. The ejection shot 17 also can serve to place a shell into the magazine. A cocking lever 19 must be cocked after the shotgun is reloaded. A trigger 21 is located on the lower side of the receiver section and is protected by a trigger guard 23. A stock 25 extends rearwardly from the receiver section 12.

A spent shell receiver 27 has a mounting bracket 29 which serves as means for mounting the spent shell receiver 27 to the shotgun 11. Mounting bracket 29 has a rear support portion 31 for mounting to the trigger guard 23. The rear support portion 31, as shown by the dotted lines in FIG. 2, has on its inner side two block portions 33 and 35 which protrude a short distance, defining a channel 36 for receiving the trigger guard. Block portions 33 and 35 are contoured so that the portion 33 will locate forwardly of the trigger guard 23, and portion 35 will locate immediately rearward of the forward portion of the trigger guard 23, with the trigger guard 23 located in the channel 36.

A retainer member 37 is adapted to be coupled to the rear support portion 31 from the opposite side of the trigger guard 23. The retaining member 37 has two protruding block portions 39 and 41 of the same contour as the block portions 33 and 35. A channel 43 is located between the block portions 33 and 35 for receiving the trigger guard 23. The block portion 41 abuts against the block portion 33 and the block portion 39 abuts against the block portion 35. The channels 36 and 43 mate and have a combined width that is slightly less than the width of the trigger guard 23. A screw 45 extends through the rear support portion 31 and retaining member 37 and is tightened by means of a wing nut 47.

Figure 2:
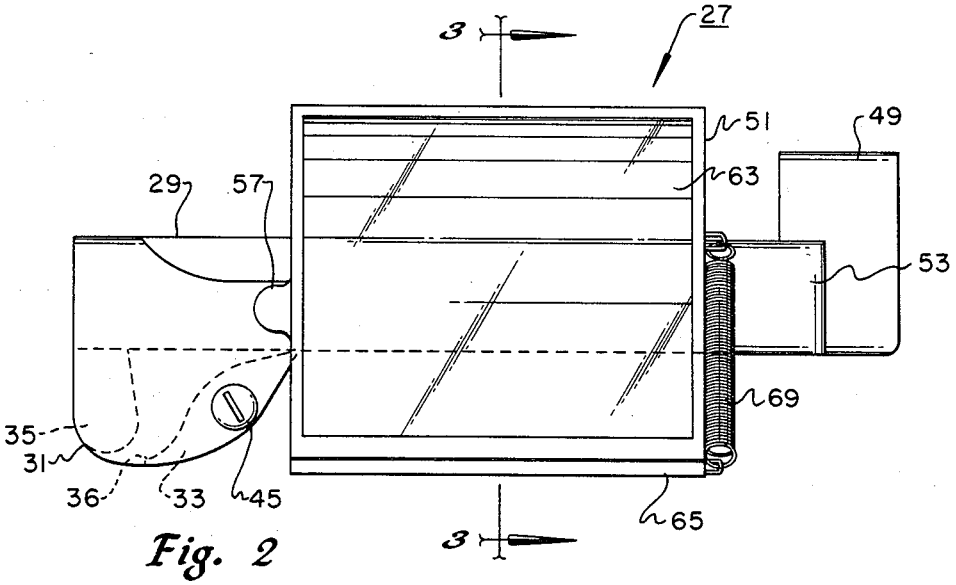
FIG. 2 is a side view of the shell receiver of FIG. 1.
Figure 3:
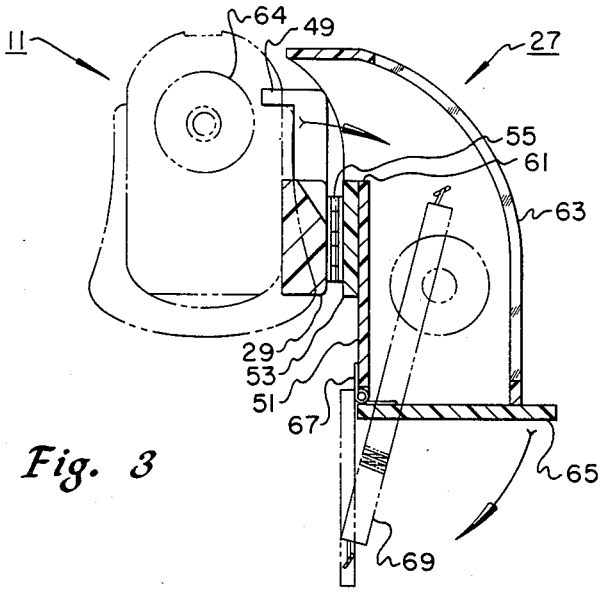
FIG. 3 is a sectional view of the shell receiver of FIG. 1, taken along the line III—III.
Figure 4:
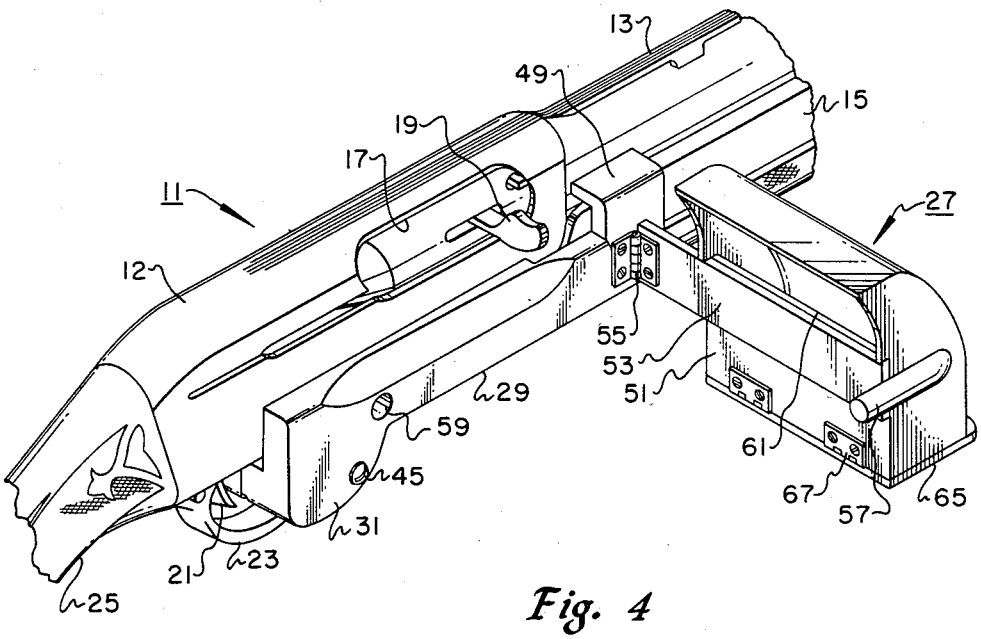
FIG. 4 is a perspective view of the shell receiver of FIG. 1, shown mounted to a shotgun and shown in an open position.

Referring to FIG. 4, the bracket 29 is supported at its forward end by means of a lip or flange 49. Flange 49 extends inwardly at a 90° angle with respect to bracket 29 for supporting contact with the upper edge of the forestock 15. A spent shell container 51 is mounted to the mounting bracket 29 by means of a brace 53 and a hinge 55. Hinge 55 has an axis that is perpendicular to the axis of the barrel 13. If the axis of the barrel 13 is assumed horizontal, the axis of the hinge 55 will be vertical. This allows the container 51 to swing outwardly from a closed position as shown in FIGS. 1-3 to an open position shown in FIG. 4. A support pin 57 located on the rearward end of the shell container 51 engages a hole 59 in bracket 29 for additional support when the shell container 51 is in the closed position.

Shell container 51 has a window 61 on its inner side the registers with the slot 17. Shell container 51 has an outer wall 63 that is shown to be a clear transparent plastic, though it need not be. The outer wall 63, as shown in FIG. 3, is spaced from the axis of the barrel 13 by a distance that is greater than the length of the shell 64. This is necessary because the shell 64 will flip as it is ejected, ending up with its forward end facing rearwardly when located in the shell container 51. A trap door 65 serves as the bottom of the shell container 51. Door 65 is connected by hinges 67 to the container 51. A spring 69 (FIG. 3) keeps the door 65 in the closed position unless pressed downwardly by the hunter to remove the spent shells 64.

In operation, the hunter mounts the shell receiver 27 to the gun 11 by placing the flange 49 on top of the forestock 15. He places the rear support portion 31 around the forward portion of the trigger guard 23. He places the retaining member 37 around the other side of the trigger guard 23 and abuts the retaining member 37 with the rear support portion 31. He secures the retaining member 37 by means of the wing nut 47.

The gun 11 is loaded from below. When fired, the shell 64 will eject and land inside the shell container 51. After the gun 11 is emptied, the hunter presses down on the door 65 to remove the spent shell 64. To recock the gun after reloading, he moves the shell container 51 to the open position shown in FIG. 4. This provides ready access to the cocking lever 19.

The invention has significant advantages. The shell receiver is mounted very quickly to the gun. No modifications to the gun are necessary. The shell receiver is out of the line of sight. The hunter is able to reload without removing the shell receiver. Easy exposure to the cocking lever is provided by swinging the container outwardly. The trap door in the shell receiver allows the shells to be quickly removed.

While the invention has been shown in only one of its forms, it should be apparent to those skilled in the art that it is not so limited but is susceptible to various changes without departing from the scope of the invention.

I claim:

1. For use with a gun having a barrel with an axis and a rearward end, a shell ejection slot located on one side adjacent the rearward end of the barrel, a spent shell receiver comprising in combination:

a bracket;

bracket mounting means for rigidly mounting the bracket to the gun adjacent the ejection slot;

a container having a window for receiving spent shells ejected from the ejection slot; and container mounting means for mounting the container to the bracket for pivotal movement about an axis perpendicular to the axis of the barrel and forward of the ejection slot between a closed position for receiving shells wherein the window is aligned with the ejection slot, and an open position exposing the ejection slot.

2. The shell receiver according to claim 1 wherein the container has a hinged door as its bottom for removing spent shells from the container.

3. For use with a gun having a barrel with a rearward end a shell ejection slot located on one side adjacent the rearward end of the barrel, a forestock located under the barrel forwardly of the ejection slot, and a trigger guard located rearwardly of the ejection slot, a spent shell receiver comprising in combination:

a bracket having a rearward end and a forward end;

a laterally projecting flange on the forward end of the bracket for insertion over an upper edge of the forestock to support the forward end of the bracket;

mounting means for releasably securing the rearward end of the bracket to the trigger guard;

a container adapted to be aligned with the ejection slot for receiving spent shells ejected from the ejection slot; and hinge means for mounting the container pivotally to the bracket for moving the bracket between a closed position for receiving shells and an open position exposing the slot.

4. The shell receiver according to claim 3 wherein the mounting means comprises:

a supporting member located on the rearward end of the bracket and positioned for contact with one side of the trigger guard;

a retaining member, separate from the supporting member and adapted to contact the other side of the trigger guard; and fastening means for securing the retaining member to the supporting member, with the trigger guard clamped therebetween.

5. For use with a gun having a barrel with a rearward end, a shell ejection slot located on one side adjacent the rearward end of the barrel, a forestock located under the barrel forwardly of the ejection slot, and a trigger guard located rearwardly of the ejection slot, a spent shell receiver comprising in combination:

a bracket having a forward end and a rearward end;

a laterally projecting flange on the forward end of the bracket for insertion over an upper edge of the forestock to support the forward end of the bracket;

mounting means for releasably clamping the rearward end of the bracket to the trigger guard;

a container having a window adapted to be aligned with the ejection slot for receiving spent shells; and hinge means for mounting the container to the bracket for pivotal movement about a vertical axis perpendicular with a horizontal axis of the barrel and forward of the ejection slot, between a closed position for receiving ejected shells and an open position exposing the ejection slot.

* * * * *